US005593369A

United States Patent [19]

Stern

[11] Patent Number: 5,593,369

[45] Date of Patent: Jan. 14, 1997

[54] INFLATABLE HAND ORTHOSIS

[75] Inventor: Elliot L. Stern, Auburn, Ala.

[73] Assignee: Orthotic Rehabilitation Products, Inc., Tampa, Fla.

[21] Appl. No.: 515,957

[22] Filed: Aug. 16, 1995

Related U.S. Application Data

[62] Division of Ser. No. 325,883, Oct. 19, 1994, Pat. No. 5,466,202, which is a continuation of Ser. No. 31,676, Mar. 15, 1993, Pat. No. 5,383,827.

[51] Int. Cl.[6] ..... A63B 23/16; A61F 5/00

[52] U.S. Cl. ..... 482/47; 482/113; 482/907; 602/13

[58] Field of Search ..... 482/44, 47, 113, 482/148, 907; 602/21, 13; 128/26

[56] References Cited

U.S. PATENT DOCUMENTS

| | | |
|---|---|---|
| 2,823,668 | 2/1958 | Van Court et al. . |
| 3,217,333 | 11/1965 | Sweet et al. . |
| 3,457,912 | 7/1969 | Clark et al. . |
| 3,581,740 | 6/1971 | Sherbourne . |
| 3,811,434 | 5/1974 | Jacobson et al. . |
| 3,901,225 | 8/1975 | Sconce . |
| 3,937,215 | 2/1976 | Barthlome . |
| 4,522,197 | 6/1985 | Hasegawa . |
| 4,619,250 | 10/1986 | Hasegawa . |
| 4,671,258 | 6/1987 | Barthlome . |
| 4,706,658 | 11/1987 | Cronin . |
| 4,907,574 | 3/1990 | Hollerbach . |
| 5,020,515 | 6/1991 | Mann et al. . |
| 5,056,504 | 10/1991 | Mann . |
| 5,113,530 | 5/1992 | Smith . |
| 5,383,827 | 1/1995 | Stern . |

*Primary Examiner*—Lynne A. Reichard
*Attorney, Agent, or Firm*—Laff, Whitesel, Conte & Saret, Ltd.

[57] ABSTRACT

An inflatable hand orthosis promotes a functional positioning of the fingers and thumb. An inflatable air bladder is formed by two vinyl sheets bonded together and inflated and deflated by a pump bulb and deflation valve, respectively, which are fixed to the vinyl sheets and communicatingly interconnected with the air bladder. The bladder is sewn into a soft cloth covering in order to form a wearable device which may be used either alone or in conjunction with hand, wrist, and finger orthosis. The hand device is placed on the palm and under the patient's fingers while deflated. Then the bladder is inflated to align and extend the fingers and to abduct the thumb.

15 Claims, 3 Drawing Sheets

Fig. 1
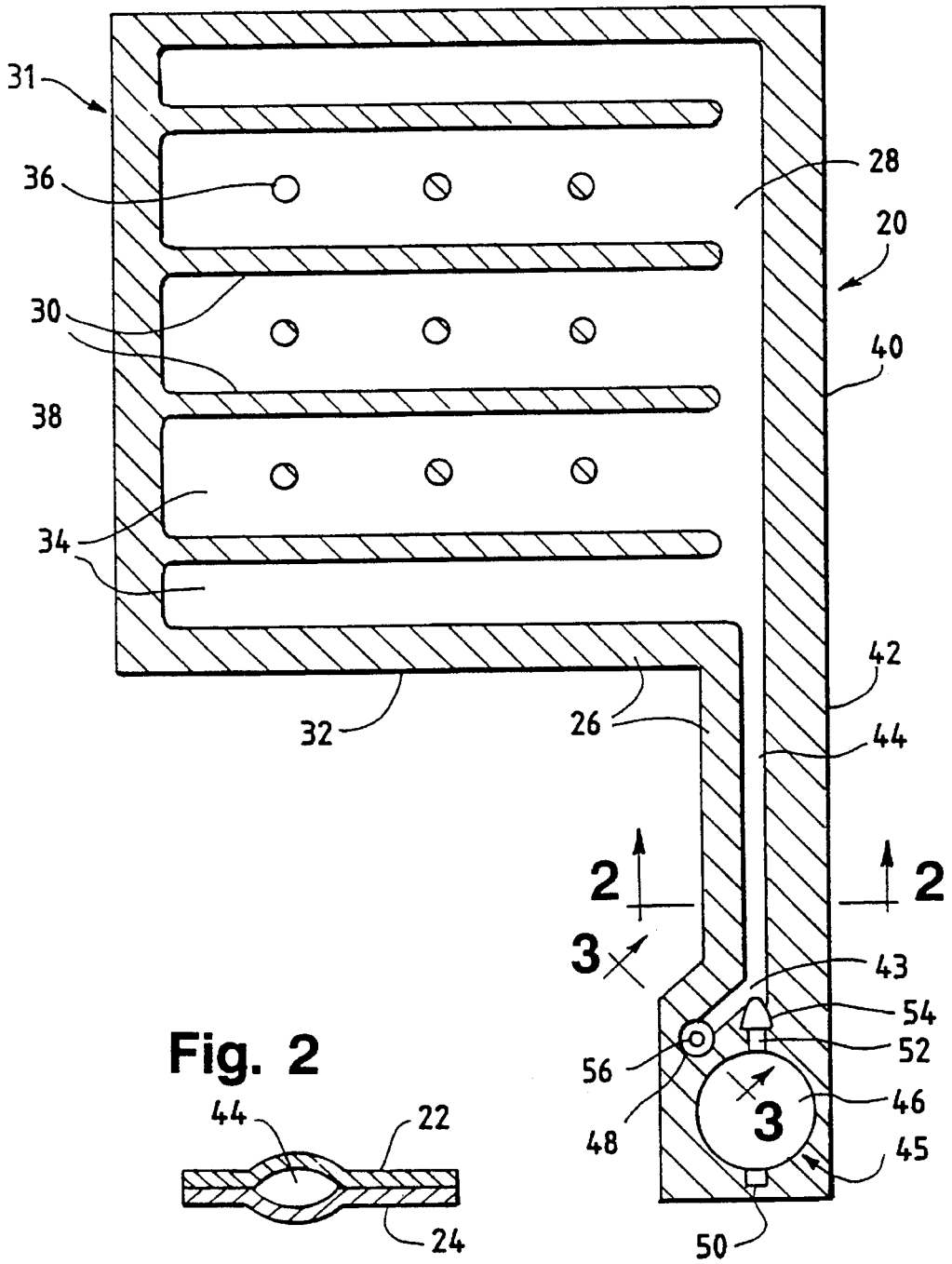
Fig. 2
Fig. 3
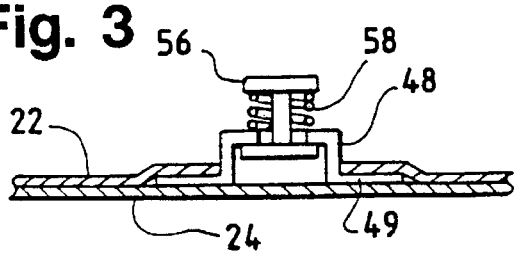

INFLATABLE HAND ORTHOSIS

This application is a division of prior application Serial No. 08/325,883, filed on Oct. 19, 1994, now U.S. Pat. No. 5,466,202, which is a continuation of application Ser. No. 08/031,676, filed on Mar. 15, 1993 (now U.S. Pat. No. 5,383,827).

FIELD OF THE INVENTION

This invention relates to inflatable finger and hand orthosis for preventing a worsening of conditions and for assisting therapeutic exercise of fingers and thumb. More particularly, this invention relates to inflatable finger and hand orthosis having bladders for extending fingers and thumb into functional positions.

BACKGROUND OF THE INVENTION

Inflatable hand devices in the form of gloves, such as those shown in U.S. Pat. Nos. 3,217,333; 4,522,197; 4,706,658; 4,907,574; 5,113,530, provide stabilization, therapeutic exercises and customized fit for comfort. Alternatively, inflatable splints may use a fluid to extend and abduct the fingers and thumb, as taught in U.S. Pat. Nos. 3,901,225 and 4,706,658. Or, a connectable air pump may be employed, as taught in U.S. Pat. Nos. 3,811,434 and 5,020,515.

Inflatable hand and wrist devices, including the above-mentioned devices, are frequently used to facilitate exercise therapy in patients suffering from arthritis, paralysis, or deformity. In general, the purpose of such pneumatic exercise devices is to assist physical therapists in moving the fingers away from the palm, as shown in U.S. Pat. Nos. 3,457,912; 3,581,740; 3,937,215; 4,671,258; and 5,056,504. Additionally, exercise devices may improve abduction of the fingers and an extension of the thumb by employing a glove with inflatable bladders positioned between the fingers, as shown in U.S. Pat. Nos. 4,522,197 and 4,619,250.

BRIEF DESCRIPTION OF THE INVENTION

Accordingly, an object of the present invention is to provide new and improved therapeutic hand devices which assist in a prevention and correction of hand and finger contracture and deformity, as well as supplement existing hand, wrist, finger orthosis.

A further object of the invention is to provide a device which may be either applied alone to the hand or may be used in conjunction with hand and wrist splints, or the like.

In keeping with an aspect of the invention, these, and other objects are accomplished by an inflatable hand device for use on patients with finger and hand contracture, deformity, or deviation. These finger and hand disorders may be due to stroke, paralysis, muscle tendon or nerve injury, contracture resulting from a burn, or similar medical conditions. Thus, an objective of the inflatable hand device is to extend and align the fingers, as well as to abduct and extend the thumb into a functional position. Once this and other objectives are achieved, the device may be employed as a therapeutic exercise device in order to strengthen and increase the range of finger and thumb motion. This is especially important because much of the hand manipulation is dependent on the pincers action of the opposing thumb and fingers, which enable the patient to grasp objects.

BRIEF DESCRIPTION OF THE DRAWINGS

The invention may be best understood by one skilled in the art by making a reference to the specification taken in connection with the attached drawings in which:

FIG. 1 is a cross section of a top plan view of the inflation bladder, including a pump bulb and deflation valve;

FIG. 2 is a cross section view of the inflation bladder, taken along line 2—2 (FIG. 1), illustrating the vinyl layers and air passageway;

FIG. 3 is a partial cross Section view taken along line 3—3 (FIG. 1), showing one embodiment of the deflation valve;

DETAILED DESCRIPTION OF THE INVENTION

Figure 4:
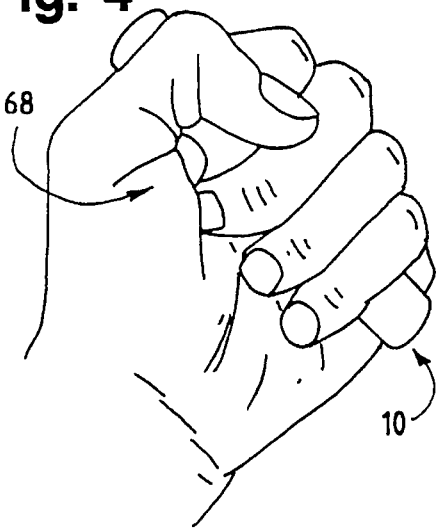
FIG. 4 is a perspective view of the inventive device, deflated under the patient's fingers.

The inventive hand device comprises an inflatable air bladder formed from two vinyl sheets which are bonded together. An outer bonded seam forms a continuous seal along the peripheral edges of the sheets, while additional seams form channels which orient the fingers. Moreover, the additional seams form tubular, interconnecting passageways which may be inflated to extend and align the fingers. Bonded islands may also be employed in the passageways to control excessive bulging of the finger passageways.

In greater detail, as depicted in FIG. 1. the inflatable hand device, generally referred to by the numeral 20, is made of two laminated vinyl layers 22 and 24 (FIG. 2). The vinyl material may be made from any suitable plastic, including polyurethane, ethylene, and ethylene vinyl acetate copolymers, polyethylene, polypropylene, polyvinyl chloride, and other related materials. Either natural or synthetic rubber can be used as the vinyl material. The layers 22, 24 may be manufactured from flat sheets of plastic film, which are die-cut and joined with solvent, ultrasonic, or thermal bonding. A continuous seam 26 (FIG. 1) extends completely around the peripheral edges of layers 22, 24 to form a seal for internal bladder 28 that will hold a suitable fluid, such as ambient air, for example.

The two sheets are bonded along a plurality of spaced parallel finger seams 30 which are located in a finger section 31 of the bladder in order to form finger receiving channels 15 which control and align the positions of the patient's fingers. Between finger seams 30 are unbonded regions which result in air tight passageways or finger tubes 34. The spacing of finger seams 30 control the inflated diameter of the finger passageways 34. Additionally, the two vinyl sheets may be locally bonded to form islands 36 in the finger tubes or passageways in order to control an excessive bulging which might otherwise occur in the finger passageways. The bladder of the inventive hand device is inflated and deflated with any suitable fluid (such as ambient air) by means of a pump bulb and deflation valve which are formed by and/or affixed to the vinyl sheets, respectively.

More particularly, finger section 31 forms part of a larger hand section 32 of the bladder 28 which has a fingertip edge 38 and a palm edge 40. Hand section 32 extends into and communicates through an air channel section 42 to the pump 45. The unbonded longitudinal region in the center of air conduit section 42 forms an air supply channel 44 (FIGS. 1 and 2) which branches at 43 into a somewhat Y-form to which air pump '45 and a deflation mechanism or air discharge valve 48 are respectively connected.

Air pump 45 includes an air pump bulb 46 which may be any suitable shape and here is shown as being generally hemispherical. Pump 45 includes an air intake port 50 and an air discharge port 52 that is fixed to a one-way air supply channel interface 54. The interface 54 causes air squeezed out of bulb 42 to move into air supply channel 44 and air to be sucked through intake port 50 when the bulb 42 is released to restore itself to its normal size. Both air supply channel interface 54 and discharge valve 48 may be, respectively, formed in and connected to the vinyl layers 22, 24.

Discharge valve 48 has a flange 49 (FIG. 3) which is laminated between vinyl layers 22, 24 in order to provide an air flow path to deflate the bladder. Dicharge valve 48 includes a spring biased valve stem 56. The resilient spring 58 in combination with the internal air pressure forcibly closes the discharge valve and air supply channel 44. Discharge valve 48 is opened if valve stem 56 is depressed. Valve stem 56 is positioned in close proximity to air pump bulb 46 for the convenience of the patient and because the relatively large size of the bulb protects the valve 48 against accidental contact in order to avoid deflation.

The bladder 28 is packaged in a soft, absorbent, and washable cloth dress 60 (FIG. 6) in order to form a wearable device which may be used either alone or in conjunction with hand, wrist, and finger orthosis. The seams of the bladder at finger edge 38, palm edge 40, and along much of air conduit section 42 are sufficiently wide to both assure a sound seal and provide additional room to sew the bladder into a soft cloth dress 60.

Figure 6:
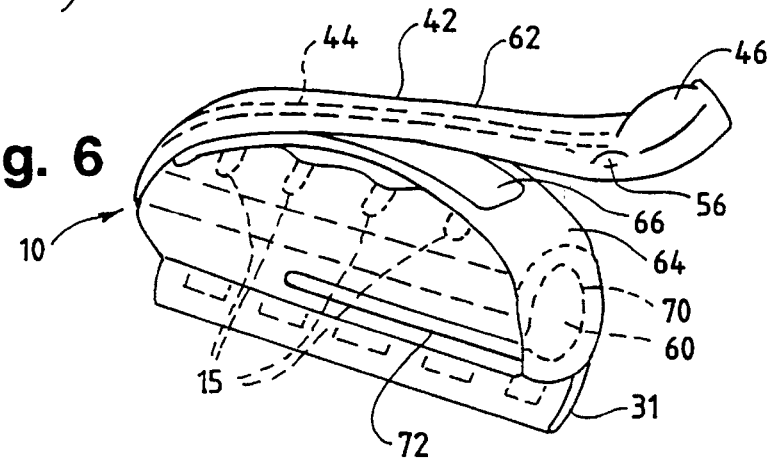
FIG. 6 is a perspective view of a partially inflated hand device, alone with the bladder and optional hand tube enclosed.

FIG. 6 illustrates the partially inflated bladder 28 within cloth dress 60 and the slight extension of finger section 31. Cloth dress 60 includes a first cloth strap 62 and a second cloth strap 64 which may be connected by any suitable fastening means 66, such as a hook and loop fastener (sold under the trademark "Velcro"). Air conduit section 42 of the bladder is sewn within first cloth strap 62 as shown in FIG. 6.

The inventive inflatable hand device is placed on the palm or surface of the hand to extend across the midpalmar space and lumbrical canals and under the patient's fingers. The position of the device avoids the thenar eminence in order to enable a proper application if the patient exhibits severe flexion of the thumb and to promote an abduction and opposition of the thumb. The device is held in place by the soft, connectable straps 62, 64 which overlap on the dorsal surface of the hand.

Figure 5:
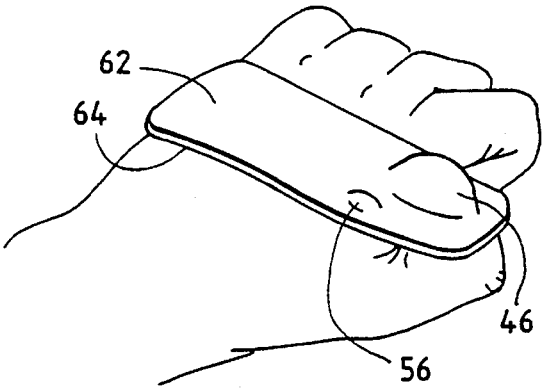
FIG. 5 is a perspective view of the deflated device illustrating a fastening strap wrapped over the dorsal side of the patient's hand showing the pump bulb and a deflation valve.
Figure 7:
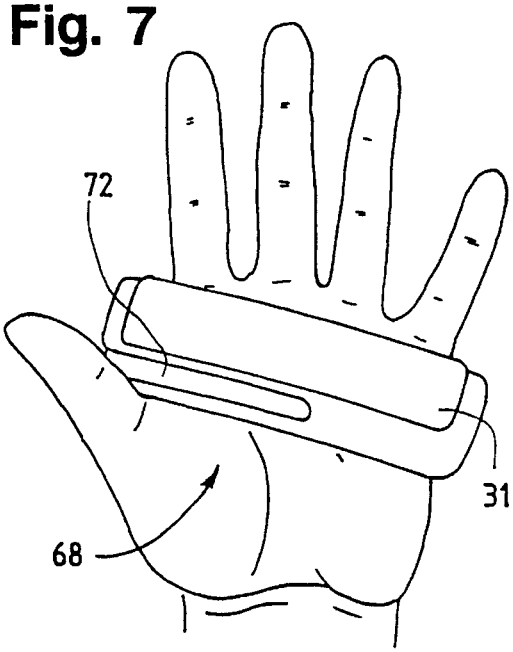
FIG. 7 is a top plan view of the palmar side of the patient's hand with fingers abducted and with the thumb extended, thus illustrating the position of the hand device within the palm.

In FIG. 4, a deflated hand device 10 is placed under the fingers, across the midpalmar space, and lumbrical canals. The deflated hand device is positioned in the hand so that it avoids that area of the hand known as the thenar eminence 68 (FIG. 7). Cloth straps 62, 64 are wrapped around the back of the hand so that they overlap on the dorsal side of the hand, as shown in FIG. 5. Pump bulb 46 may then be squeezed or depressed repeatedly to inflate bladder 28 via air passageway 44. As the air passes into the finger tubes, the inflated finger tubes 34 cause the patient's fingers to align and to extend away from the palmar region, resting in the depressed regions over the welded finger seams 30. The fingers remain in this position until valve stem 56 is depressed to deflate the bladder 28.

After the patient's fingers have been partially extended by the inflated bladder, a closed-cell, foam tube 70 may be placed in the cloth dress for increasing the diameter of the inflated bladder 28, as illustrated in FIG. 6. There may be a plurality of foam tubes 70 having different diameters for selectively increasing the outer diameter of the hand devices in order to adjust for more or less severe hand conditions.

Figure 10A:
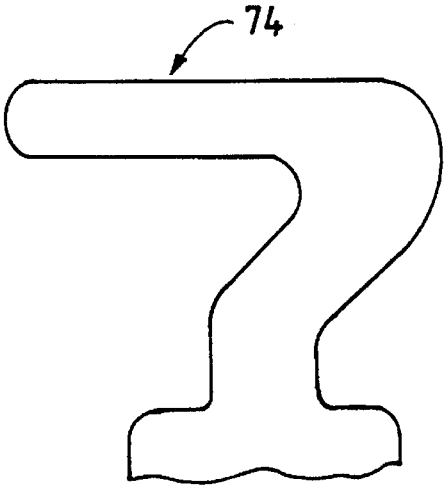
FIGS. 10A and 10B are partial top plan views of two embodiments of hand, wrist, and finger orthosis which may be used in conjunction with the inflatable hand device.
Figure 10B:
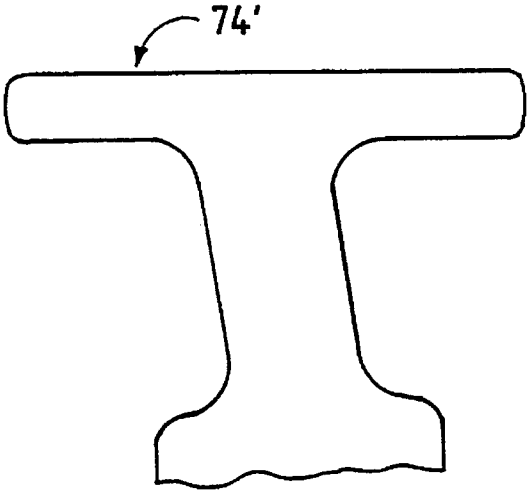

Cloth dress 60 includes a slot 72 (FIG. 6) which facilitates a use of the hand device with 'splints. For example, the hand device may be employed in conjunction with hand, wrist, and finger orthosis including, but not limited to, the two finger splints 74 and 74' which are partially illustrated in in FIGS. 10A and 10B. Cloth dress 60 may be placed either directly over the finger splints or used with foam tube 70, which is inserted into longitudinal slot 72 or another and corresponding slot in cloth dress 60.

Figure 8:
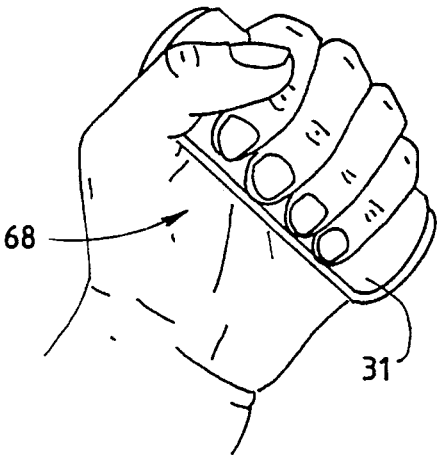
FIG. 8 is a perspective view of the patient's hand after partial extension of the fingers and abduction of the thumb.
Figure 9:
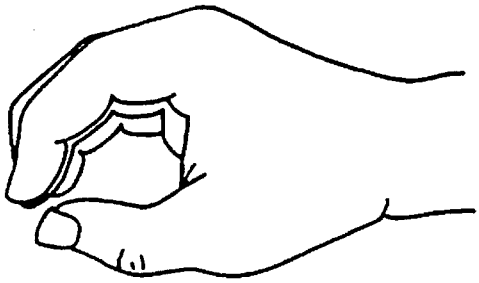
FIG. 9 is a perspective view of the patient's hand in a position of function where it is capable of pincer action following use of the inflatable hand device.

The inflatable hand device promotes a partially cupped position (FIG. 9) of the hand, forming a concavity of the palm in the process. To achieve this cupped position, the thumb is abducted and placed in a partially opposed position while it is slightly flexed. In greater detail, FIG. 8 illustrates the patient's hand with aligned fingers and a partially flexed and abducted thumb. Finger section 31 extends the finger tips away from the enclosed foam tube 70 and from the palmar region, to be flexed and rotated at the metacarpophalangeal joints. The resulting functional position of the patient's fingers and thumb capable of pincer action is depicted in FIG. 9.

Thus, the inventive inflatable hand device provides the advantages of directed hand and finger treatment for the prevention of further deterioration and for the correction of finger and thumb contracture, deformity, or deviation due to a variety of medical conditions. In addition, the inventive hand device provides a means for staged treatment and therapeutic exercise, including the utilization of other hand, wrist, and finger splints. The inflation bladder of the inflatable hand device extends the fingers away from the planar region of the hand and extends and abducts the thumb.

The welded finger seams 30 inherently result in finger receiving channels 15 which aid in the alignment and orientation of the fingers. The bladder within the cloth dress may be rolled tightly prior to its placement under severely flexed fingers, including those with fingernails imbedded in the planar region. As the bladder is pumped up, the fingers are forced to extend, with a degree of gentleness selected by the rate of pumping. The intrinsically flat nature of the bladder and the use of bonded islands prevents ballooning of the inflated bladder which may unevenly extend the fingers or could worsen the condition as, for example, causing a further ulnar deviation of the fingers. The soft, absorbent and washable cloth dress reduces tissue maceration. The integral pump and deflation valve facilitate ease of use and allows for immediate deflation if required.

It should be recognized that, while the invention has been described in relation to a preferred embodiment thereof, those skilled in the art may develop a wide variation of structural details without departing from the principles of the invention. Therefore, the appended claims are to be construed to cover all equivalents falling within the true scope and spirit of the invention.

The claimed invention is:

1. A therapeutic method of extending fingers and thumb on a hand closed in a substantially clenched fist, said method comprising the steps of:

(a) inserting a deflated bladder under the fingers and between the thumb and fist, said bladder being shaped to conform to the shape of a hand with its palm, fingers, and thumb;

(b) attaching said bladder around said hand;

(c) pumping up said bladder to extend said fingers and thumb in the shape of said bladder and to force said hand out of said clenched fist; and forming said bladder to guide and direct said fingers and thumb as they extend in response to pumping up said bladder.

2. A method for moving fingers of a hand comprising:

positioning an inflatable bladder between the palm and the fingers of the hand with one side of the bladder against the palm and the other side against the fingers of the hand;

inflating the bladder to move the fingers; and providing integrally formed channels in the bladder for receiving the fingers as the bladder is inflated.

3. The method according to claim 2, wherein the step of providing integrally formed channels includes providing integrally formed arcuate channels for receiving curled fingers.

4. The method according to claim 2, wherein the step of positioning the bladder includes securing the bladder to the hand.

5. A method for moving fingers of a hand comprising:

positioning an inflatable bladder between the palm and the fingers of the hand with one side of the bladder against the palm and the other side opposite the palm;

inflating the bladder to move the fingers;

forming channels for receiving the fingers as the bladder is inflated; and folding the bladder when it is substantially deflated to fit in the hand when the fingers are curled.

6. A method for moving fingers of a hand comprising:

positioning an inflatable bladder between the palm and the fingers of the hand with one side of the bladder against the palm and the other side opposite the palm;

inflating the bladder to move the fingers;

forming channels for receiving the fingers as the bladder is inflated; and rolling the bladder when it is substantially deflated to form a rolled bladder with a cross-section sufficiently small to be positioned in the hand when the fingers are curled.

7. The method according to claim 6, wherein the step of positioning the bladder comprises positioning the outer end portion of the rolled bladder opposite the inner surfaces of the curled fingers.

8. The method according to claim 7 and the step of unrolling the outer end portion by inflating the rolled bladder so that the outer end portion pushes against the inner surfaces of the curled fingers.

9. The method according to claim 8 and the step of inflating and deflating the rolled bladder multiple times.

10. The method according to claim 6 and the step of providing the bladder with a plurality of substantially parallel and elongated passageways between the partitions and wherein the step of forming channels includes forming the bottoms of the channels from the partitions and the sides of the channels from opposing surfaces of elongated passageways which are adjacent each other.

11. The method according to claim 10 wherein the step of rolling the bladder comprises rolling up the surface substantially in the direction of the longitudinal axes of the elongated passageways.

12. The method according to claim 6, wherein the step of rolling includes rolling the bladder around a cylindrical insert to increase the diameter of the rolled bladder.

13. The method according to claim 2 and the step of deflating and reinflating the bladder at least one time.

14. A method for extending curled fingers of a hand comprising:

providing a substantially planar bladder with a plurality of substantially parallel, spaced partitions and elongated passageways between the partitions;

rolling the bladder when substantially deflated in the direction of the longitudinal axes of the elongated passageways so as to form a rolled bladder with the elongated passageways extending substantially from the inside edge to the outside edge of the roll;

positioning the rolled bladder between the palm and the fingers with the outside end portion of the roll opposite the curled fingers;

inflating the rolled bladder to form arcuate finger receiving channels between the elongated passageways and to move the outer end portion toward the inner surfaces of the fingers, thereby extending the curled fingers.

15. The method of claim 9, wherein the step of positioning the rolled bladder includes positioning the outer edge of the rolled bladder to face substantially away from the palm and toward the fingertips.

* * * * *